US008931178B2

(12) United States Patent
Beam

(10) Patent No.: US 8,931,178 B2
(45) Date of Patent: Jan. 13, 2015

(54) CLIPPER DEFLECTOR FOR DEFLECTING AIR AND CUTTINGS AWAY FROM OPERATOR

(76) Inventor: Albert Beam, Downingtown, PA (US)

( * ) Notice: Subject to any disclaimer, the term of this patent is extended or adjusted under 35 U.S.C. 154(b) by 474 days.

(21) Appl. No.: 12/932,369

(22) Filed: Feb. 24, 2011

(65) Prior Publication Data

US 2012/0216410 A1 Aug. 30, 2012

(51) Int. Cl.
*B26B 19/38* (2006.01)
*B26B 19/48* (2006.01)

(52) U.S. Cl.
CPC ..... *B26B 19/3813* (2013.01); *B26B 19/3853* (2013.01)
USPC ..... 30/123; 30/133; 30/210

(58) Field of Classification Search
CPC B26B 19/38; B26B 19/3806; B26B 19/3813; B26B 19/3853; B26B 19/44; B26B 19/48; B23D 59/006
USPC ..... 30/123, 124, 133, 208–210, 216; D28/53; 15/300.1; D23/387, 388
See application file for complete search history.

(56) References Cited

U.S. PATENT DOCUMENTS 1,528,430 A * 3/1925 Josten et al. ..... 30/133
2,182,597 A 12/1939 Oster
2,294,713 A 9/1942 Boerger
2,542,333 A 2/1951 Hotz et al.
2,697,876 A * 12/1954 Blanchard ..... 30/133
2,748,472 A * 6/1956 Sheley et al. ..... 30/133
3,217,407 A * 11/1965 Azar ..... 30/133
3,279,023 A * 10/1966 Zobel ..... 30/133
3,348,308 A * 10/1967 Andis ..... 30/133
3,384,919 A * 5/1968 Jording et al. ..... 30/133
3,900,949 A * 8/1975 Anzalone ..... 30/133
3,979,825 A 9/1976 Baumann ..... 30/133
4,077,122 A * 3/1978 Rollor et al. ..... 30/133
4,216,581 A * 8/1980 Van Slooten ..... 30/133
4,576,331 A * 3/1986 Harwell ..... 454/329
4,623,810 A 11/1986 Smith ..... 310/90
4,630,604 A * 12/1986 Montesi ..... 128/206.15
4,843,717 A 7/1989 Crane ..... 30/133
4,870,714 A * 10/1989 Miner ..... 15/327.5

(Continued)

FOREIGN PATENT DOCUMENTS

GB 2410457 A * 8/2005
JP 2000-189231 A 7/2000

(Continued)

OTHER PUBLICATIONS

Applicant's International Search Report including written opinion of the International Searching Authority PCT/US2011/001700.

*Primary Examiner* — Jason Daniel Prone
(74) *Attorney, Agent, or Firm* — Robert B. Famiglio; Famiglio & Associates

(57) ABSTRACT

An air flow deflector which may be retrofit onto an existing hair or animal fur hand clipper. Deflector attaches to the clipper by various means to cover existing air flow channels or air vents on the clipper and directs the clipper motor cooling air away from the clipper. The deflector prevents hair and fur from being blown by such air vents in random directions during use of the clipper by redirecting the existing cooling air away from the clipper housing in a preferred direction. Retrofitting existing clippers is accomplished by attaching the deflector on the clipper over existing vents.

8 Claims, 10 Drawing Sheets

(56) References Cited

U.S. PATENT DOCUMENTS

| | | | | |
|---|---|---|---|---|
| 5,199,174 | A * | 4/1993 | Wild | 30/123.3 |
| 5,261,389 | A * | 11/1993 | Trieb | 126/85 B |
| 5,269,073 | A * | 12/1993 | Johnson | 30/133 |
| 5,463,816 | A * | 11/1995 | Bellew et al. | 30/415 |
| 5,661,873 | A * | 9/1997 | Karet | 15/415.1 |
| D387,487 | S | 12/1997 | Sulik | D28/53 |
| 6,043,575 | A * | 3/2000 | Ghode et al. | 310/52 |
| D434,528 | S | 11/2000 | Kling | D28/53 |
| 6,155,149 | A * | 12/2000 | Colson | 30/123 |
| 6,158,528 | A * | 12/2000 | Izumisawa | 173/93.5 |
| 6,173,499 | B1 * | 1/2001 | Hegoas et al. | 30/123.3 |
| 6,739,053 | B2 | 5/2004 | McCambridge et al. | 30/34.1 |
| 6,796,386 | B2 * | 9/2004 | Izumisawa et al. | 173/93.5 |
| 6,854,542 | B2 * | 2/2005 | Schoonover | 180/68.2 |
| 7,076,878 | B2 | 7/2006 | Degregorio | |
| 7,635,298 | B2 * | 12/2009 | Henneberry | D23/387 |
| 7,762,000 | B2 | 7/2010 | Williams | 30/210 |
| 7,997,275 | B2 * | 8/2011 | Quinn | 128/836 |
| 8,484,853 | B1 * | 7/2013 | Laube | 30/133 |
| 2005/0200087 | A1 * | 9/2005 | Vasudeva et al. | 279/143 |
| 2006/0162516 | A1 | 7/2006 | Andis et al. | 83/13 |
| 2006/0174487 | A1 * | 8/2006 | Andis et al. | 30/34.05 |
| 2006/0230619 | A1 * | 10/2006 | Williams et al. | 30/133 |
| 2008/0116753 | A1 | 5/2008 | Carlucci | 310/50 |
| 2009/0042505 | A1 * | 2/2009 | Henneberry | 454/292 |
| 2009/0199413 | A1 | 8/2009 | Tautscher et al. | 30/243 |
| 2011/0307039 | A1 * | 12/2011 | Cornell | 607/105 |
| 2012/0156982 | A1 * | 6/2012 | DeSouza | 454/307 |
| 2012/0279073 | A1 * | 11/2012 | Snow et al. | 30/295 |
| 2013/0269205 | A1 * | 10/2013 | Hada | 34/283 |

FOREIGN PATENT DOCUMENTS

| | | | |
|---|---|---|---|
| WO | WO-01-83172 | A1 | 11/2001 |
| WO | WO 2012115612 | A1 * | 8/2012 |

* cited by examiner

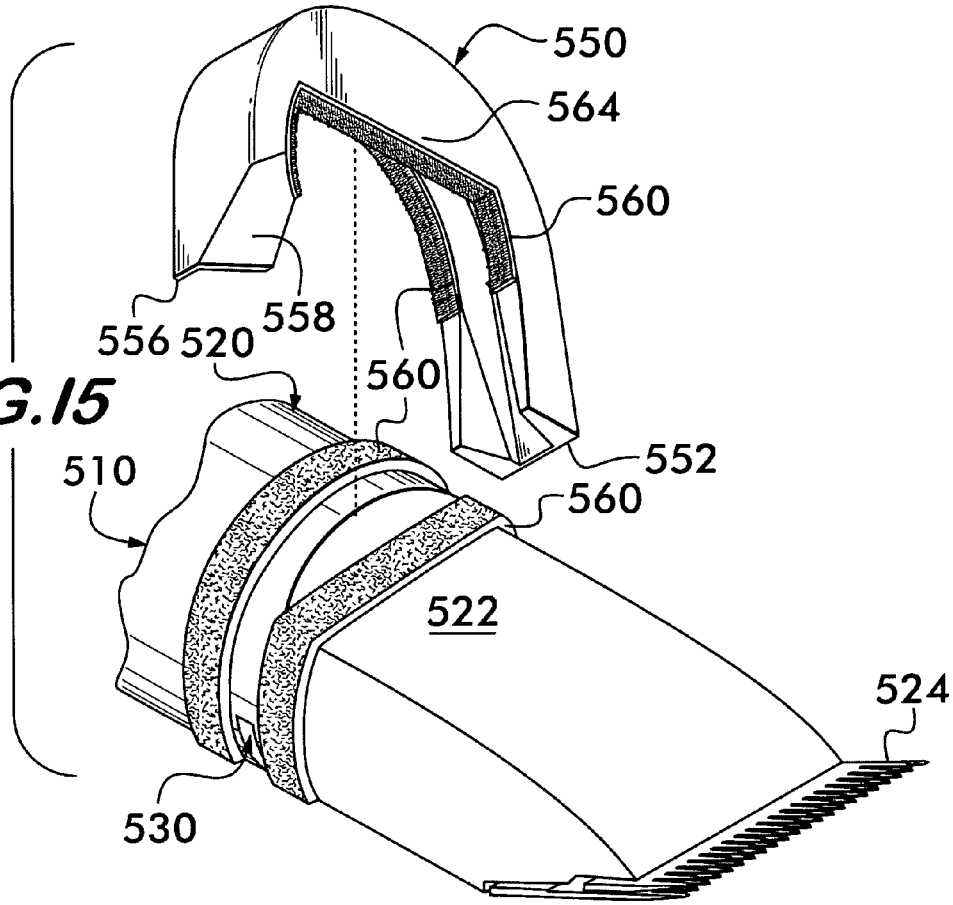
FIG.15
FIG.16
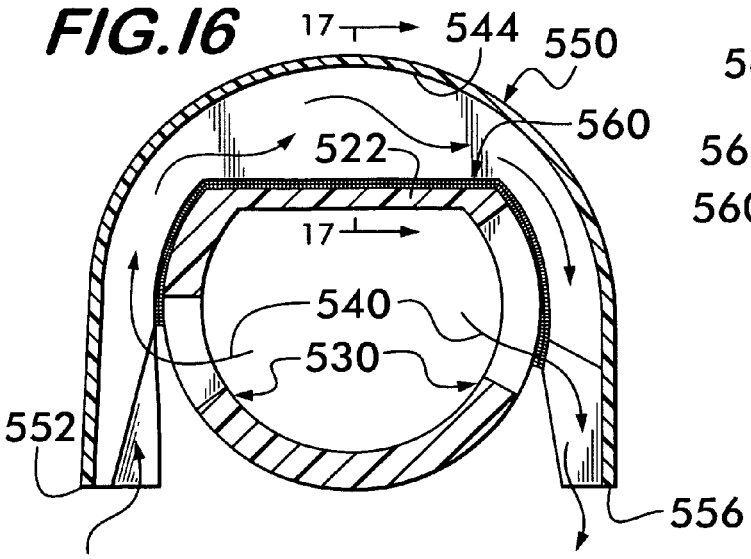
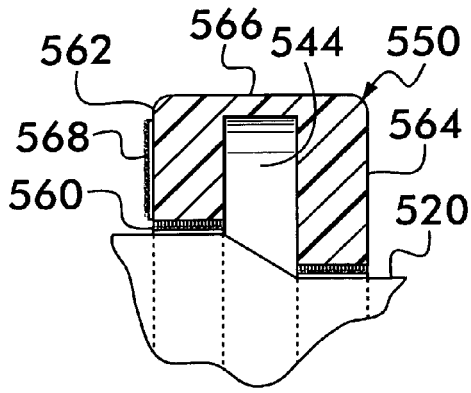
FIG.17

FIG.21
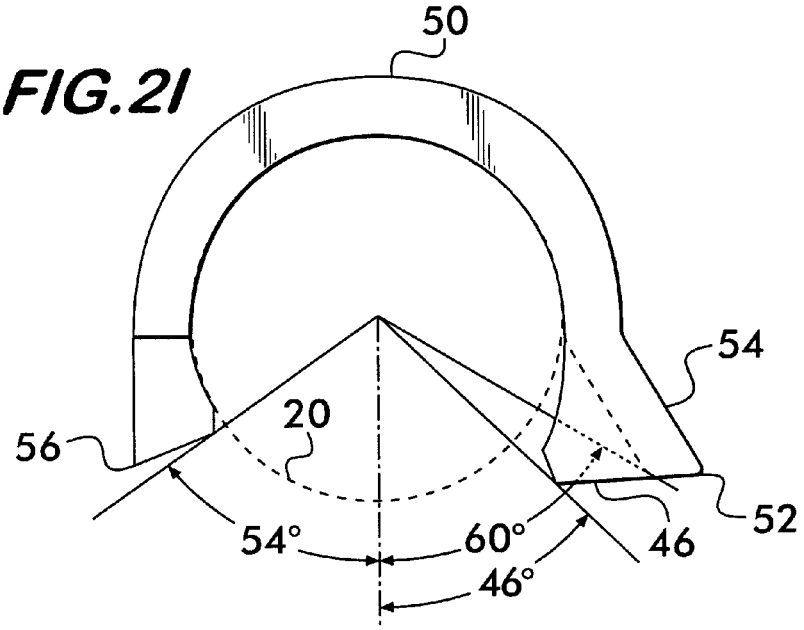
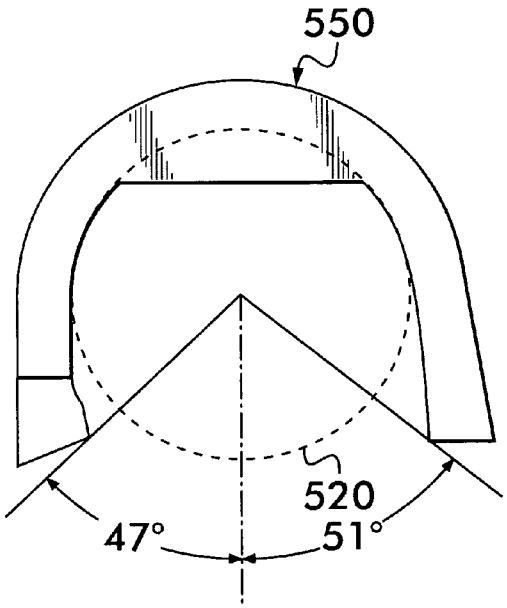
FIG.22
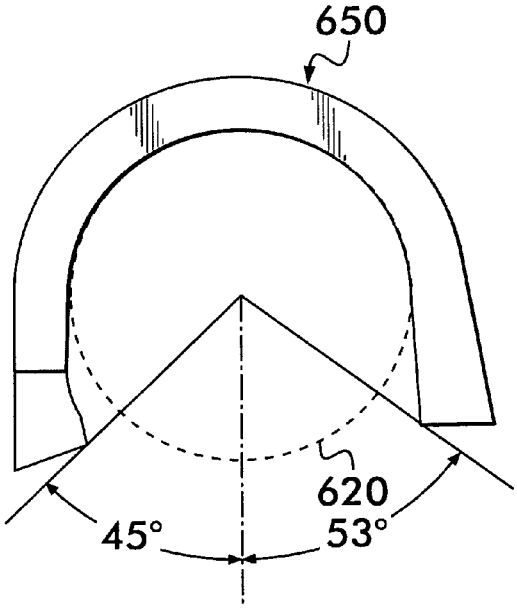
FIG.23

CLIPPER DEFLECTOR FOR DEFLECTING AIR AND CUTTINGS AWAY FROM OPERATOR

FIELD OF THE INVENTION

The present invention relates to a clipper motor cooling air deflector system for deflecting cooling air and clippings away from the operator. More particularly, the present invention relates to a clipper motor cooling air deflector which deflects cooling air along with cuttings, such as hair, from the clipper away from the operator without interfering with the proper air flow for cooling of the motor.

BACKGROUND OF THE INVENTION

For many years, clippers have been utilized for clipping the hair of horses and other animals, people, and things such as carpeting. These clippers utilize an electric motor within a housing wherein cooling air is drawn into the housing across the motor and out through outflow vents. The housings are typically generally cylindrical, and although they may have flattened portions and other deviations from exactly cylindrical, they are generally an elongated cylindrical structure with an electric motor and an air flow cooling means contained therein, which causes substantial outflow of air directed through outflow vents radially outward from the center and into the face of the operator. When the operator is trimming the hair of animals, human hair, carpeting or other material or living things which are to be clipped, the cuttings of the clipper are often thrown into the face of the operator. This presents an extremely uncomfortable and unhealthy working and environmental condition. This condition has existed for many years in this field. of endeavor, some of these clippers having been in use for more than seventy years without remedying this significant uncomfortable and unhealthy working condition.

SUMMARY OF THE INVENTION

An advantage of the present invention is that it produces a clipper in which motor cooling air passing through outlet vents which may carry clippings is directed away from an operator.

Another advantage of the present invention is that by directing the motor cooling air away from the operator, particularly away from the face of the operator, clippings from the clipper which may be airborne are not blown into the face of the operator or otherwise in the direction of the operator.

This cooling air may have ozone in it as it passes over an electric motor which may have brushes causing sparking and ozone. Another advantage of the present invention is that the ozone laden air is directed away from the operator.

Another advantage of the present invention is that the deflector of the present invention does not obstruct the motor cooling air from flowing properly through the outlet vents.

Another advantage of the present invention is that it may be adapted as an after market attachment to existing clippers or it may be built into the housing of new clippers being manufactured.

Another advantage of the present invention is that it provides significant advantages in work place comfort and safety without significant additional cost.

Briefly and basically, in accordance with the present invention, apparatus is provided which forms a motor cooling air deflector on a clipper having an electric motor within a housing and means for forcing cooling air over the motor and through one or more outlets or outlet vents in the housing of the clipper, wherein the housing is comprised of a generally cylindrical shape.

The term "generally cylindrical shape" as used throughout means any generally cylindrical in cross section shape which may have flattened or other non-circular portions on its circumference, which may be hexagonal, octagonal or any other shape. It is generally an elongated shape having a periphery which somewhat approximates in cross section a circular shape, although it need not be circular in cross section.

The apparatus of the present invention on a clipper, is in the form of a motor cooling air deflector means which comprises a channel over at least one of the air flow outlets. Preferably, the channel would cover all of the air flow outlets which are directed upwardly and out of either side of the housing, but leaving downwardly directed air free for air flow. The term upwardly and downwardly will be defined more particularly with respect to the drawings hereinafter, but generally upwardly is directed upwardly from the top of the clipper, that is radially upwardly in the direction of where an operator would normally be positioned. Downwardly refers to the radially outward direction which is directed to the object, animal or person being clipped. It is understood that upwardly is defined in reference to the top of the clipper and the airflow although defined to be upwardly may actually be directed downwardly in certain circumstances such as where the clipper is being used to clip hair from the underside of a horse.

The channel means, which may be a generally inverted U-shaped structure has a first and second end and covers a span of at least 120 degrees of the circumference of the housing. The span of the clipper covered in a preferred embodiment would be in excess of 180 degrees. The channel is provided with a first and a second end downwardly directed. The channel is provided with a first end which in one preferred embodiment may have a flared input and provided at a second end with a vane for directing air flow out of said channel and backwardly along the housing of the clipper. The flared input end, in a preferred embodiment, may be provided with a shield on the forward side, that is the side closest to the clipping blades, to help prevent clippings from being drawn into the channel as a result of rotation of an air movement means such as a fan. Preferred embodiments will be described more fully hereinafter.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 15 is a partially broken away exploded view in perspective of the air and cuttings deflector of FIG. 14 being attached to the clipper.

FIG. 16 is a cross sectional view taken along line 16-16 of FIG. 14.

FIG. 17 is a partially broken away cross sectional view taken along line 17-17 of FIG. 16.

FIG. 21 is an elevation diagram showing the span of the deflector around the generally cylindrical housing of the embodiment of FIGS. 1 through 4.

FIG. 22 is an elevation view of the span of coverage of the deflector around the generally cylindrical housing of the clipper of the embodiments of FIGS. 14, 15, 16 and 17.

FIG. 23 is an elevation view of the span of coverage of a deflector around the generally cylindrical housing of the embodiment of the clipper illustrated in FIGS. 18, 19 and 20.

DETAILED DESCRIPTION OF THE PREFERRED EMBODIMENTS

Figures 1, 3, 3A, 4:
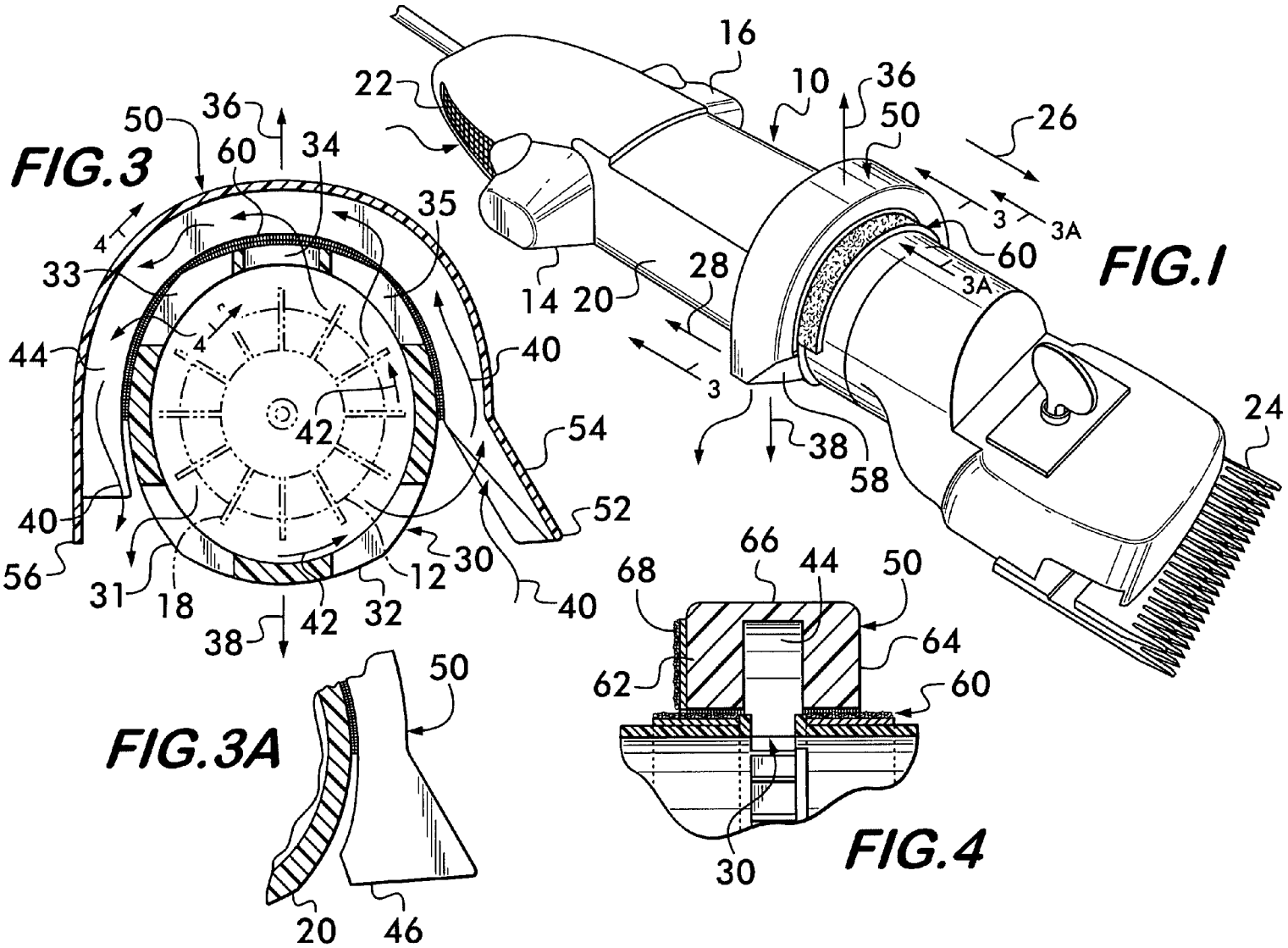
FIG. 1 is a view in perspective of a clipper utilizing an air and cuttings deflector attachment in accordance with one preferred embodiment of the present invention.
FIG. 3 is a cross sectional view taken along line 3-3 of FIG. 1.
FIG. 3A is a partially broken away cross sectional view taken along line 3A-3A of FIG. 1.
FIG. 4 is a partially broken away cross sectional view taken along line 4-4 of FIG. 3.

Referring now to the drawings, wherein like numerals indicate like elements, there is shown in FIGS. 1, 2, 3, 3A, 4 and 21 a presently preferred embodiment of the invention utilized in connection with a clipper 10 which may be considered to be a heavy duty clipper utilized for clipping horse hair, other coarse hair of animals, such as sheep and other animals, carpeting and other material which might be considered to be coarser or thicker than human hair. Clipper 10 has an electric motor 12, as shown generally by dotted outline in FIG. 3, which drives clipper blades 24. Electric motor 12 may be of various types, but as shown in the embodiment of FIG. 1 is provided with housings 14 and 16 for brushes.

Means for forcing cooling air 18 over motor 12 is also indicated generally in dotted outline form. Means for forcing cooling air 18 may be any suitable type of fan or other means for moving air, including but not limited to propeller type fans, centrifugal fans such as straight radial blade, curved blade and squirrel cage fans and any other suitable means for moving air over motor 12 for cooling of the motor. Cooling air is drawn into the housing 20 through one or more inlet vents 22, through housing 20 and over motor 10 to cool the motor. In electric motors having brushes, there may be some arcing which may create ozone.

The cooling air after being drawn over motor 12 exits through one or more outlets or outlet vents 30 in the housing 20 of the clipper. Outlets or outlet vents 30 may be comprised of multiple outlets and as illustrated in FIG. 3 for the specific clipper of FIGS. 1-4 and 21 clipper may be comprised of five outlet vents 31, 32, 33, 34 and 35. However, it is understood that more or less vents may be utilized in a particular clipper.

As illustrated in FIGS. 1 and 3, upward is defined to be in the direction of arrows 36, that is directed away from the top of clipper 10. Downward or downwardly are defined to be away from the bottom of clipper 10 indicated by the direction of arrows 38. In other words, upwardly is in the direction away from the top of the clipper, normally in the direction of the operator and particularly normally in the direction of the face of the operator. Downwardly is in the direction away from the bottom of the clipper and is usually in the direction of the animal, person or object being clipped. In some circumstances, what is referred to herein throughout as upwardly directed air flow may actually be downward with respect to the earth, for example where the underside of a horse or other animal is being clipped and the clipper is physically upside down. The terms upward or upwardly and downward or downwardly as used throughout including the claims are as defined herein.

It may be seen that outlets or outlet vents 31 and 32 are substantially downwardly directed. Outlet vent 34 is upwardly directed and outlets or outlet vents 33 and 35 are generally upwardly and somewhat laterally directed.

The direction of rotation of the means 18 for forcing cooling air over motor 12, such as propeller or fan wheel 18 is counter clock wise as indicated in FIG. 3 by arrow 42 for the embodiment of FIGS. 1, 2, 3, 3A, 4 and 21. Although the majority of the air flow is in the direction from the rear to the forward part of housing 20 of clipper 10, there is also some airflow in the direction of arrow 42 due to the rotation of the means for forcing cooling air or fan 18 and this is shown by the airflow arrows 40 in FIG. 3.

The housing 20 of clipper 10, and the various other clippers described herein and referenced in the claims, is "generally cylindrically" shaped. Generally cylindrical means herein throughout an elongated housing having a somewhat circular shape in cross section, but the shape need not be perfectly cylindrical and in fact may have significant flattened portions such as is illustrated in the embodiment of FIGS. 14, 15, 16, 17 and 22 where there is a substantial flattened portion in the clipper housing. Additionally, other variations from cylindrical may occur including shapes such as hexagonal, octagonal and other variations and deviations as long as the channel or air flow deflector of generally inverted U-shaped structure is adapted to conform to the shape of the housing. This definition set forth herein and above is the definition of "generally cylindrical" to be used throughout including the specification and claims.

Figure 2:
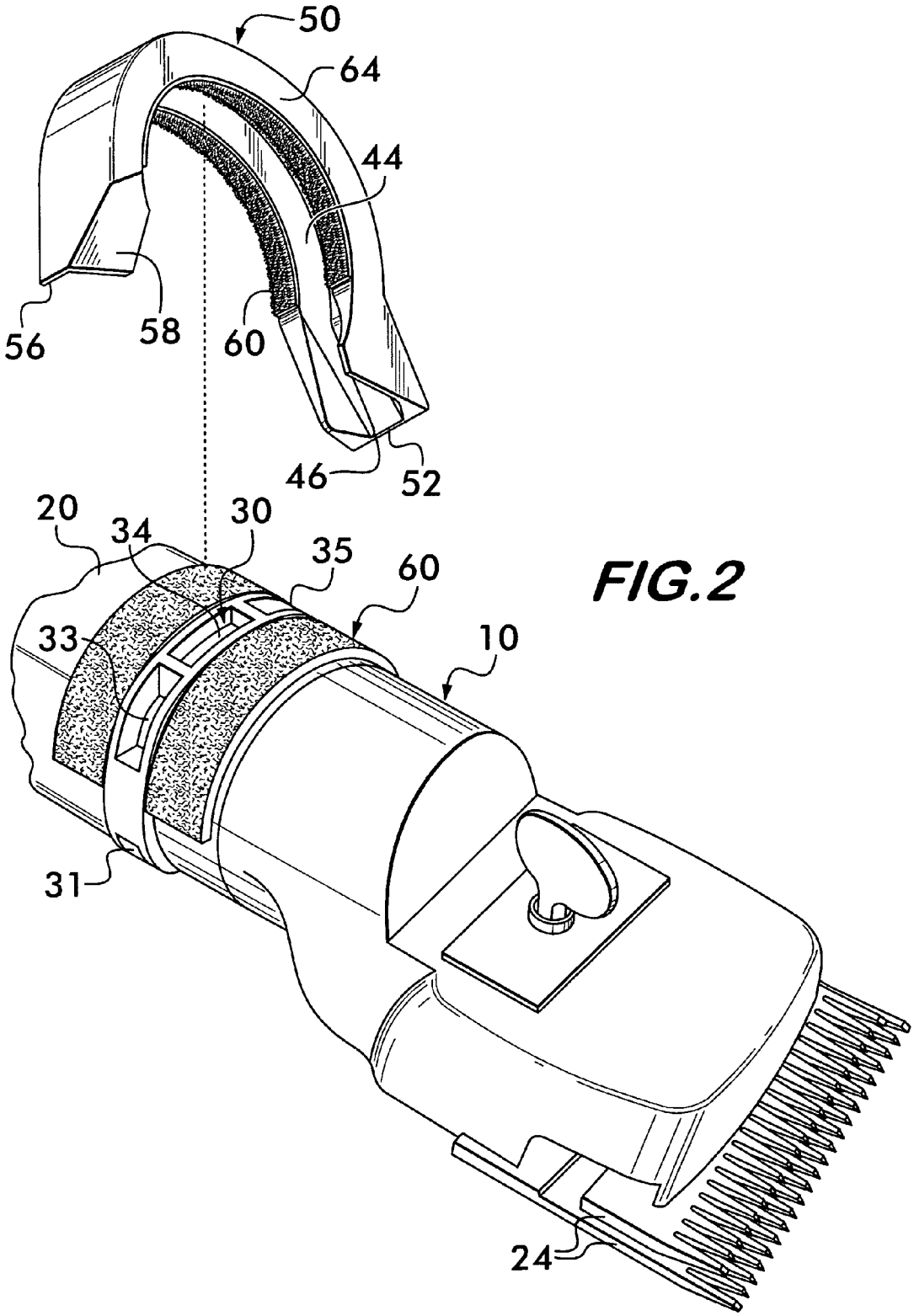
FIG. 2 is a partially broken away exploded view in perspective showing the deflector being attached to a clipper in accordance with the embodiment of FIG. 1 of the present invention.

Referring now again to FIGS. 1 through 4 and 21, there is shown a motor cooling airflow and cutting or cutting debris deflector 50 which is comprised of a channel 44 over at least one of the airflow outlets or outlet vents 30. As best seen in FIGS. 2 and 3, airflow and cutting debris deflector 50 is provided with a first end 52 which is provided with a flared input 54. Flared input 54 is provided on its forward or leading side with a shield 46 best seen in FIGS. 2 and 3A to help prevent cuttings or cutting debris from clipper blades 24 from being drawn into channel 44 of deflector 50 and to help prevent cutting debris from being drawn into the air flow. Deflector 50 has a second end 56 which is provided with a vane 58 for directing airflow along housing 20 of clipper 10. Backward or backwardly is indicated by arrow 28 and forward or forwardly is indicated by arrow 26 in FIG. 1. Although the bulk of the airflow is drawn by the fan from input vent 22 and through housing 20 over motor 12, since air forcing means or fan 18 is rotating in the counter clockwise direction 42 as viewed in FIG. 3, air is drawn into first end 52 of airflow deflector 50 and out of second end 56 and is directed by vane 58 along housing 20. If the air forcing means or fan 18 were rotating in the opposite direction, everything would just merely be reversed. Of course fan rotation in either direction is within the scope of the present invention. Air deflector 50 prevents air with cuttings or cutting debris from blowing towards an operator and particularly prevents it from blowing into the face of an operator. This is particularly important since cutting blades 24 of the clipper 10 are cutting hair or other material and this cut material is airborne and would be blown into the face of the operator. These cuttings or debris would be breathed in by the operator causing adverse effects on the operator's respiratory system, particularly if done over a period of time.

The span of airflow deflector 50 around the circumference or perimeter of housing 20 between first end 52 and second end 56 should be at least 120 degrees to prevent airflow from being directed directly into the face of the operator. Use of the term circumference throughout is not intended to in any way limit this invention or the housings to which it is applied to being circular in cross section, but covers all housings and deflectors which conform to the shape of the housing even though it may have flattened portions or may have other deviations from circular as defined above with respect to "substantially cylindrical". Preferably, the span between the first end 52 and the second end 56 of the air deflector 50 is more than 180 degrees and in a presently preferred embodiment as illustrated in FIG. 21, the span between the first end 52 and second end 56 may span approximately 246 degrees or 260 degrees if measured between flared input 54 and shield 46 and the second end 56, respectively, as illustrated in FIG. 21. In other words, the span of deflector 50 around the circumference of housing 20 between second end 56 and the shield would be approximately 246 degrees. The coverage of deflector 50 around the housing 20 from second end 56 to the inside of flared input 54 would be approximately 260 degrees.

In a presently preferred embodiment, airflow deflector 50 is comprised of a channel 44 which receives the outflow air from outlets or outlet vents 30 and allows the air to pass in an unobstructed manner downwardly in the direction of arrow 38 out of deflector 50, without being directed into the face of the operator or generally in the direction of the operator. In a presently preferred embodiment as best illustrated in FIGS. 2 and 4, the channel may be in the form of an inverted U-shape having legs 62 and 64 connected at their outer end by a member 66. The lower end of the legs are shaped to conform to the housing 20 of clipper 10 in the area immediately adjacent outlets or outlet vents 30. The air deflector channel or inverted U-shaped structure is attached to or secured to the housing by various suitable means. As illustrated in the embodiment of FIGS. 1 through 4, this may be done by suitable hook and loop fasteners 60 which form a bond between the legs of the inverted U-shaped member and the housing. The hook and loop fasteners are commercially available under the Trademark "Velcro". The hook and loop fasteners 60 not only form a means for securing channel 44 or deflector 50 to housing 20, but also form a seal between the inverted U-shaped member legs and the housing. One of the hook or loop fasteners is attached to the housing by adhesive and the other of the hook and loop is attached to the ends of the inverted U-shaped legs 62 and 64 by adhesive. In a presently preferred embodiment, Velcro or a resilient cushioning member 68 may be provided on the back side of deflector 50 as best illustrated in FIG. 4 to provide a cushioning effect for the hand or fingers of an operator.

The embodiment of the invention shown in FIGS. 1-4 and 21 and described herein was built and tested to successfully operate as intended deflecting air and cutting debris away from the operator.

Figure 5:
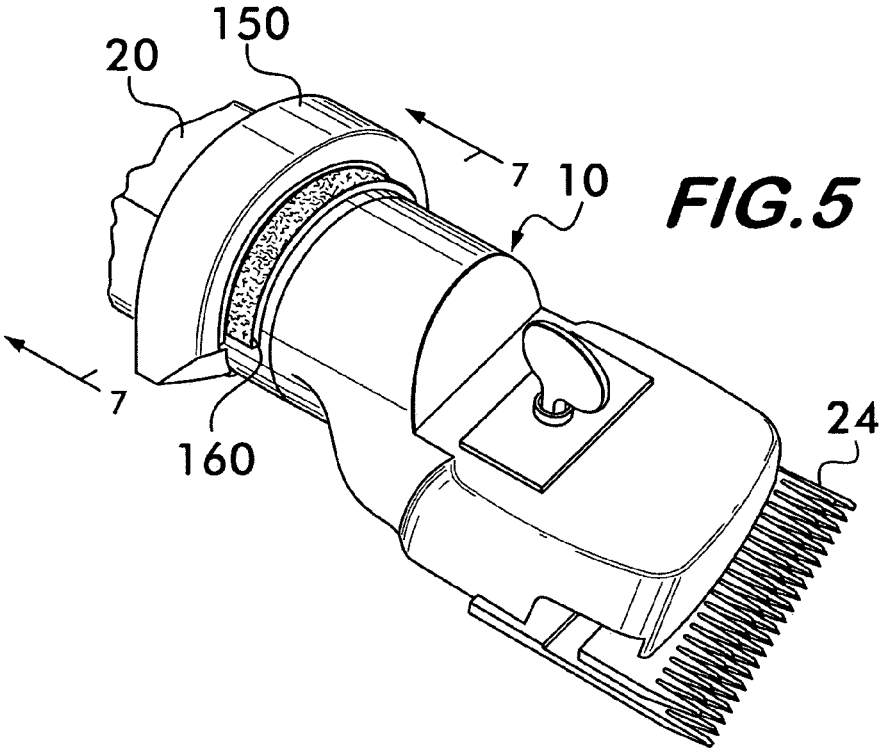
FIG. 5 is a partially broken away view in perspective of an embodiment of the present invention utilizing a resilient attachment means for attaching the air and clippings deflector to the clipper.
Figure 7:
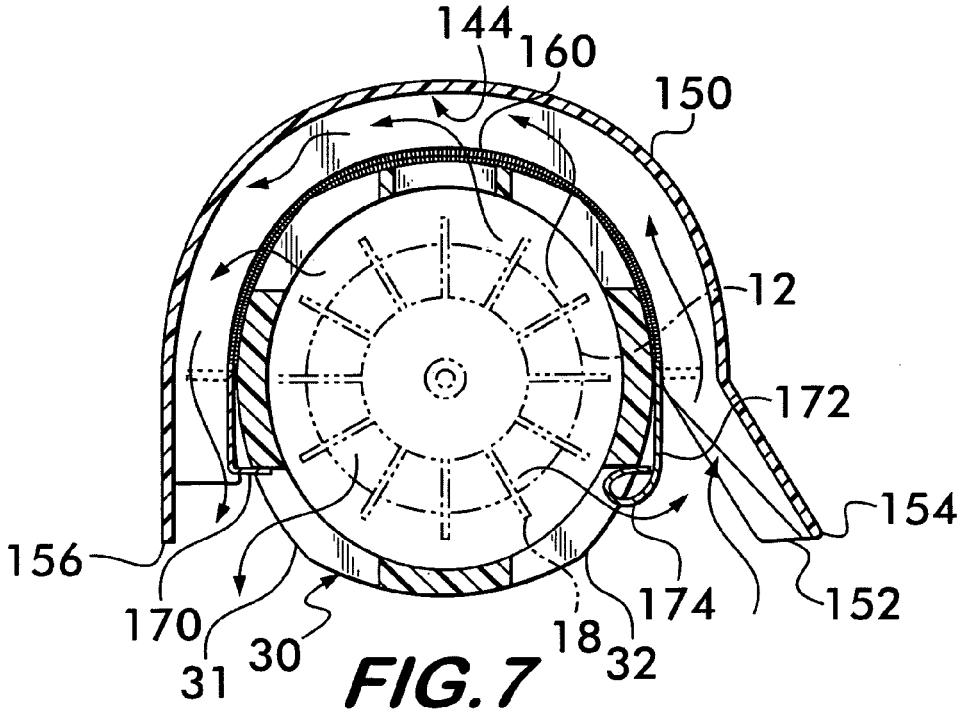
FIG. 7 is a cross sectional view taken along line 7-7 of FIG. 5.
Figure 6:
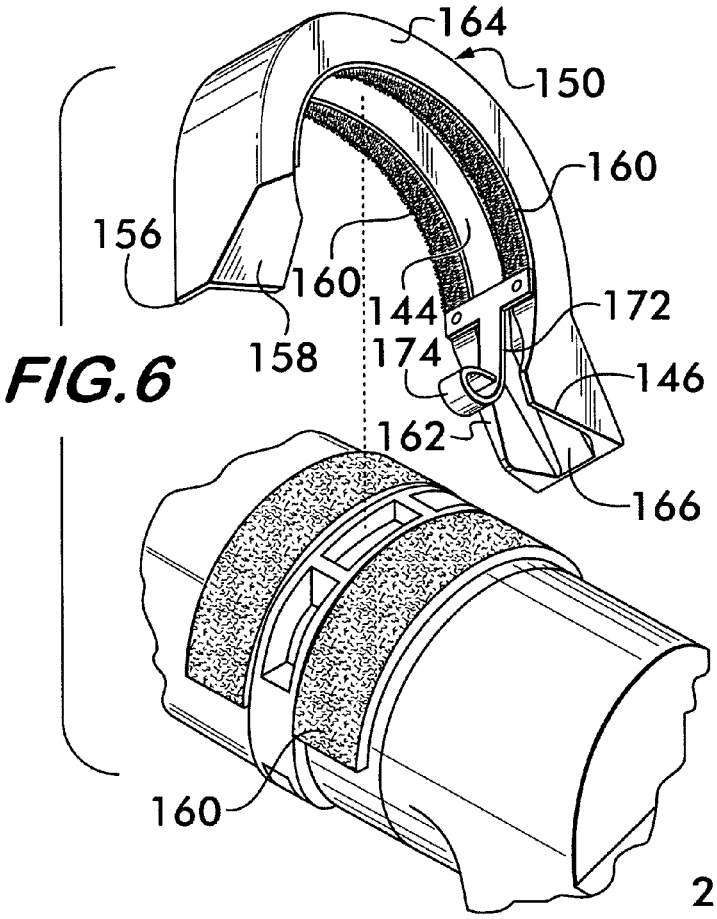
FIG. 6 is a partially broken away exploded view in perspective of a deflector in accordance with FIG. 5 being attached by resilient means or a leaf spring.

Referring now particularly to the embodiment shown in FIGS. 5, 6 and 7, there is shown an embodiment of the present invention wherein an air and cuttings deflector attachment 150 is attached to the generally cylindrical housing 20 of a clipper 10 by mechanical means and particularly by mechanical means in the form of a catch 170 for engaging a sidewall surface of a first outlet 31 in the housing as best seen in FIG. 7 and a spring member 172 with a curled end 174 or otherwise rounded end for engaging a sidewall of a second outlet 32 in the housing as best seen in FIG. 7. The channel is attachable to the housing and removable from the housing by flexing of the spring member 172. Velcro 160 or other resilient sealing means is utilized primarily as a seal between the deflector attachment 150 and the housing 20. The curled end 174 of spring member 172 enables or enhances the ability of the spring member 174 to slide over housing 20 and be engaged within an outlet or outlet vent opening of housing 20. The curled end 174 also allows for easier disengagement of spring member 172 and deflector 150 from generally cylindrical housing 20 of clipper 10. The input end or first end 152 is provided with a flared input 154 which includes a shield 146 as described with respect to the previous embodiment of FIGS. 1 through 4 and 21. The second end 156 is provided with a vane 158 for directing air flow backwardly as described with respect to the previous embodiment described with respect to FIGS. 1 through 4 and 21.

The deflector 150 operates in a similar manner to that described with respect to deflector 50, including the deflection of air away from the operator by means of the use of channel 144 comprised of an inverted U shaped structure having legs 162 and 164 which conform to the shape of housing 20. Deflector 150 is provided with a shield 146 on its leading edge of the input 152 and a rearward deflecting vane 158. As described with respect to deflector 50, deflector 150 does not obstruct the cooling motor airflow and prevents air and clippings from being thrown generally towards the operator and particularly from being thrown into the face of the operator.

The embodiment of the invention shown in FIGS. 5-7. and described herein was built and tested to successfully operate as intended deflecting air and cutting debris away from the operator.

Figure 8:
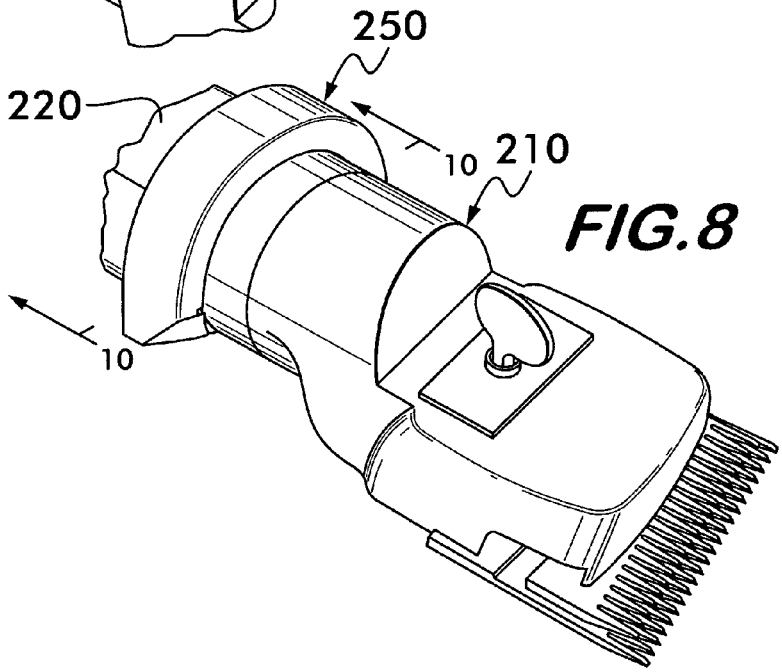
FIG. 8 is a partially broken away view in perspective of an air and clippings deflector in the form of an attachment which is mounted to the clipper by other mechanical means as illustrated being a key hole and key structure.
Figure 9:
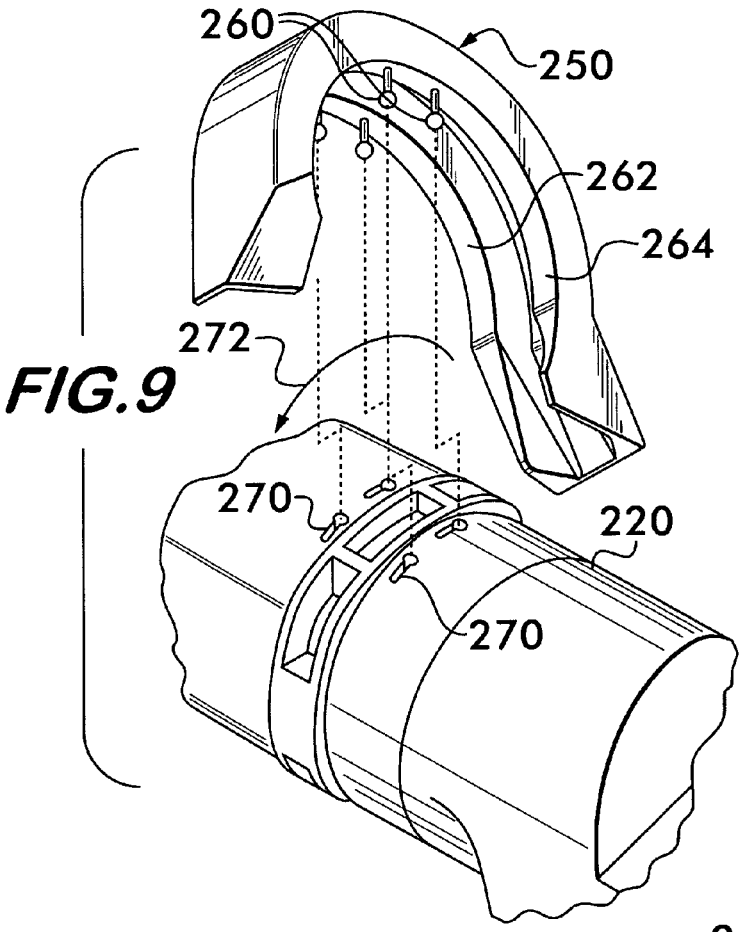
FIG. 9 is a partially broken away exploded view in perspective of the embodiment of FIG. 8 showing keys on the deflector attachment being inserted into key holes in the housing of the clipper.
Figure 10:
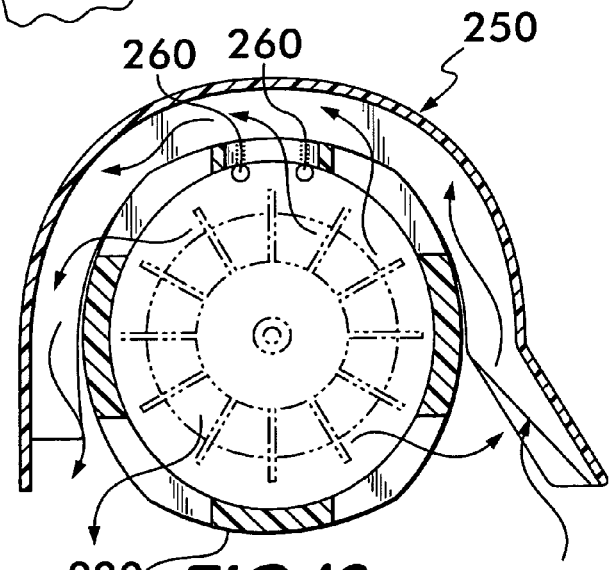
FIG. 10 is a cross sectional view taken along line 10-10 of FIG. 8.

Referring now to the embodiment shown in FIGS. 8, 9 and 10, there is shown an embodiment of the present invention wherein an air and cuttings deflector attachment 250 is attached to the generally cylindrical housing 220 of a clipper 210 by mechanical means and particularly by mechanical means in the form of keys 260 which are insertable and lockable in key holes 270 by means of a short or small amount of rotation of deflector 250 on cylindrical housing 220. As best illustrated in FIG. 9, the keys 260 are inserted into the enlarged opening of the key hole 270 and then deflector 250 is rotated slightly in the direction of arrow 272 to lock deflector 250 onto housing 220 by engaging the enlarged portions of keys 260 in the narrow channels of the key holes 270. The key holes 270 may be formed into housing 220 by molding or may be machined into the housing as desired at the time of manufacture or thereafter.

As best illustrated in the cross sectional view of FIG. 10, the keys 260 are shown engaged within the slots of the key holes 270 securely attaching deflector 250 to housing 220. The remaining structure of deflector 250 is substantially the same as that described with respect to deflector 50 with respect to FIGS. 1 through 4 and 21. As illustrated in FIGS. 8, 9 and 10, the hook and loop fastener may be eliminated and a seal may not be needed where the deflector is precisely formed to the shape of the housing 220. Alternatively, a resilient seal of various types may be provided between the bottoms of legs 262 and 264 of inverted U-shaped channel of deflector 250 and housing 220.

Figure 11:
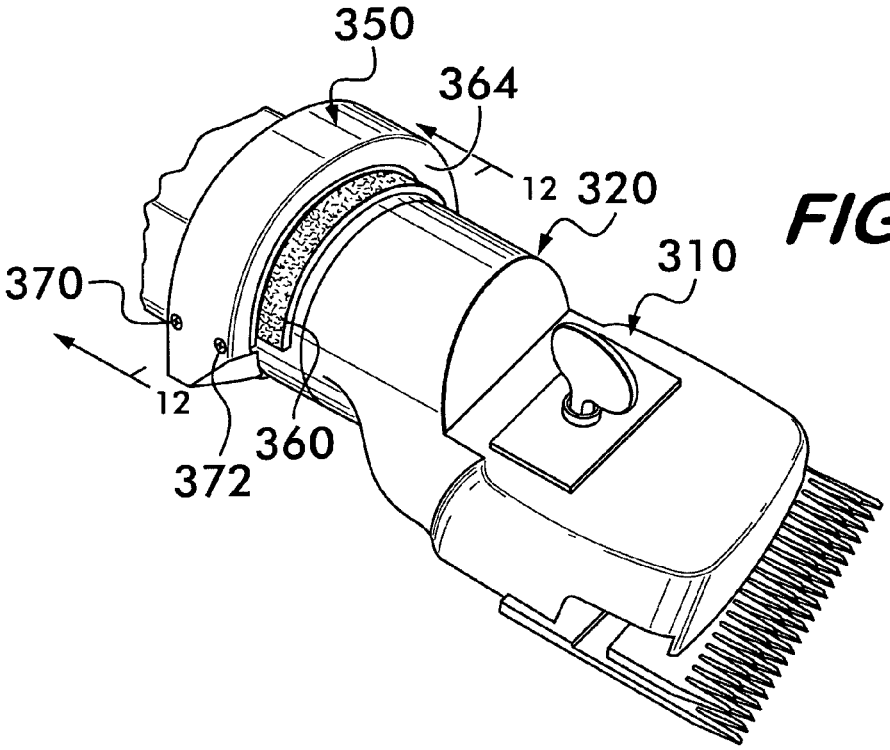
FIG. 11 is a partially broken away perspective view of a deflector mounted by mechanical means in the form of fasteners to the clipper.
Figure 12:
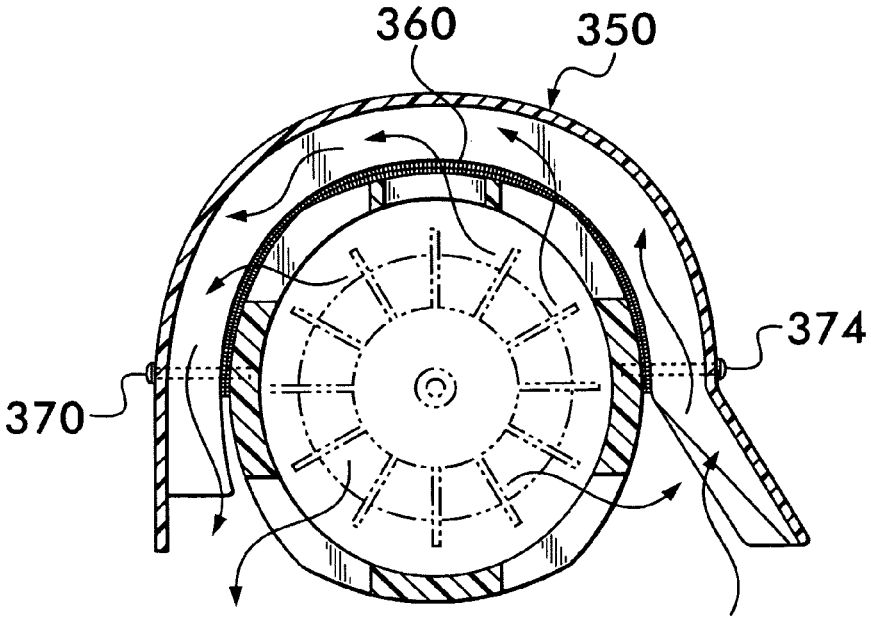
FIG. 12 is a cross sectional view taken along line 12-12 of FIG. 11.

Referring now particularly to the embodiment shown in FIGS. 11 and 12, there is shown an embodiment of the present invention wherein an air and cuttings deflector attachment 350 is attached to the generally cylindrical housing 320 of a clipper 310 by mechanical means and particularly by mechanical means in the form of threaded fasteners 370, 372 and 374. The threaded fasteners may be bolts as illustrated in FIGS. 11 and 12 or any other suitable type of threaded fastener. The fasteners may be any suitable type of fasteners including non threaded fasteners such as rivets. The fasteners may be inserted into holes in housing 320 which may be drilled and threaded or they may be inserted into drilled or formed holes using self tapping threaded fasteners. The holes may be formed in the housing at the time of manufacture or they may be drilled in to the housing 320 after the time of manufacture.

The structure of deflector 350 is otherwise substantially the same as the structure described with respect to deflector 50. The lower ends of the legs of the inverted U-shaped channel of which deflector 350 is constructed may be sealed to housing 320 by means of hook and loop fasteners 260 or by other resilient means forming a tight seal between the lower ends of legs 362 and 364 and the outer surface of housing 320.

Figure 13:
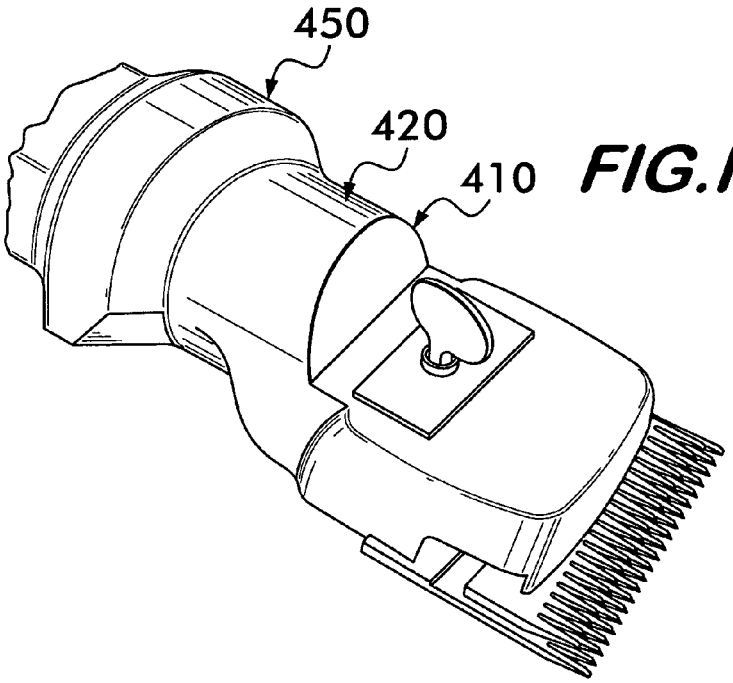
FIG. 13 is a partially broken away view in perspective of an air and clippings deflector formed intrinsically as a part of a housing of a clipper.
Figure 14:
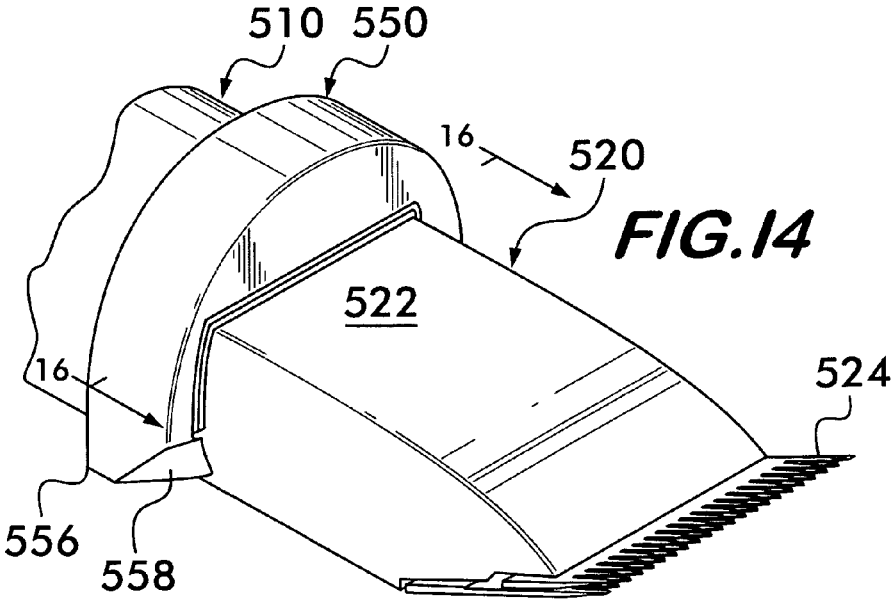
FIG. 14 is a partially broken away in perspective of a clipper with a generally cylindrical housing having a flattened portion to which the air and cuttings deflector is formed to conform.
Figure 18:
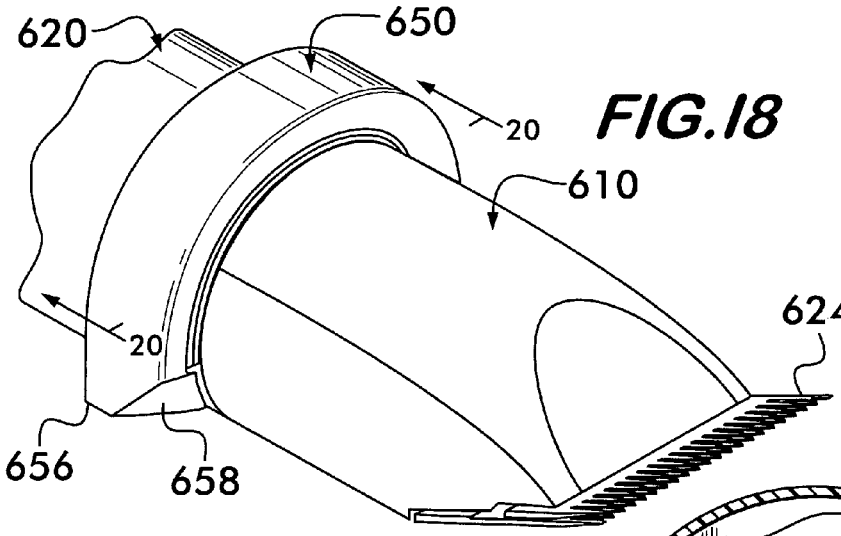
FIG. 18 is a partially broken away view in perspective of an air and cuttings deflector attachment as may be attached to a clipper utilized for clipping human hair.

Referring now particularly to the embodiment shown in FIG. 13, there is shown an embodiment of the present invention wherein an air and cuttings deflector 450 is formed as an integral part of the generally cylindrical housing 420 of a clipper 410. Deflector 450 in this embodiment is integrally formed by molding at the time of manufacture of housing 420. Generally, the structure of deflector 450 may be substantially similar to that described with respect to deflector 50 of the embodiment described with respect to FIGS. 1 through 4 and 21 except that the structure is integrally formed as a part of housing 420. This would be formed at the time of manufacture of the clipper 410.

Referring now particularly to the embodiment shown in FIGS. 14, 15, 16, 17 and 22, there is shown an embodiment of the present invention wherein an air and cuttings deflector 550 is attached to generally cylindrical housing 520 of a clipper 510 by various means and as particularly illustrated in these figures by hook and loop fasteners 560. Any suitable means of attachment may be utilized. Clipper 510 has a generally cylindrical housing 520 with a flattened portion at 522. Clipper 510 has clipping blades 524 and outlets or outlet vents 530 for cooling motor airflow out of housing 520. Airflow is generally indicated by airflow arrows 540.

As best seen in FIGS. 15 and 16, airflow and cutting debris deflector 550 is provided with a first end 552 into which some air is drawn by the rotation of means for moving cooling air as described above and a second end 556 which is provided with a vane 558 for directing airflow backwardly along housing 520 of clipper 510. Unlike the embodiment of FIGS. 1 through 4 and 21, neither a shield nor a flared input is required on input end 552. This may be due at least in part to clipper 510 being of a smaller size than clipper 10. However, a shield and/or a flared input may optionally be provided within the scope of the present invention if desired. As with the first embodiment, vane 558 directs air and any clippings backwardly along housing 520, with backwardly being defined the same as previously and throughout. As with all of the embodiments, fan or air moving means may rotate in either direction within the scope of the present invention, and such change of rotation of direction would merely result in a reversal of the input 552 and output 556 structures.

As described with respect to the previous embodiments, the air flow deflector 550 may be a channel in the form of an inverted U-shaped having legs 562 and 564 connected at their outer end by a member 566. The lower ends of the legs 562 564 are shaped to conform to the housing 520 where the legs engage the housing of clipper 510 in the area immediately adjacent outlets or outlet vents 530. The air deflector channel or inverted U-shaped structure may be attached to or secured to the housing 520 by various suitable means such as hook and loop fasteners 560 as illustrated. The hook and loop fasteners 560 not only form a means for securing channel 544 or deflector 550 to housing 520, but also form a seal between inverted U-shaped member legs 562 and 564. As with the previous embodiments, the hook and loop fasteners may be attached to the bottom of the legs 562 and 564 and to the areas of the housing adjacent the outlets or outlet vents 530 by adhesive or other suitable means.

As discussed with respect to FIG. 4, Velcro or other cushioning material 568 may be provided on the back side of deflector 550 as best illustrated in FIG. 17 to provide a cushioning effect for the hand or fingers of an operator.

This embodiment of FIGS. 14, 15, 16, 17 and 22 specifically illustrates one generally cylindrical housing to which a deflector of the present invention may be attached wherein one of the areas adjacent the outlets or outlet vents has a flattened portion. In other clippers, both sides adjacent the outlets may have flattened portions or there may be other deviations from truly circular in cross section of the housing. It is understood that the shape of the deflector legs 562 and 564 would be adjusted to make a tight fit to the outer surface of housing 520 of clipper 510. Various other variations in the shape of the housing of the clipper may be accommodated in accordance with the present invention.

Referring to FIG. 22, there is shown a diagram of the span of deflector 550 around housing 520 of clipper 510. As illustrated therein and as indicated by the measurements on FIG. 22, the deflector may be considered to span approximately 262 degrees of the circumference of housing 520. Of course, other spans may be utilized including spans of as little of 120 degrees, but preferably more than 180 degrees. Greater or lesser degrees of span may be utilized in practicing the present invention.

The embodiment of the invention shown in FIGS. 14-17 and 22 and described herein was built and tested to successfully operate as intended deflecting air and cutting debris away from the operator.

Referring now particularly to the embodiment shown in FIGS. 18, 19, 20 and 23, there is shown an embodiment of the present invention wherein an air and cuttings deflector attachment 650 is attached to the generally cylindrical housing 620 of a clipper 610 wherein the clipper is of a smaller size than the clipper shown in FIG. 1 and is usually used for cutting human hair and other similar materials. The attachment or deflector 650 is of similar structure and construction to those described in the previous embodiments and may be attached by hook and loop fasteners 660 or other suitable attaching means. Clipper 610 is provided with clipping blade 624 and air outlets or outlet vents 630. Although this embodiment is shown with deflector 650 attached by hook and loop fasteners, such as Velcro, which not only forms a fastener, but also a seal, the deflector 650 may be attached by any suitable means including but not limited to the various mechanical means described previously. Deflector 650 is substantially similar to deflector 550 described with respect to the previous embodiment. It is provided with a first end or input end 652 and a second end or an output end 656. The output end 656 includes a backwardly deflecting vane 658. Attachment or deflector 650 operates in a manner similar to that described for the previous embodiment and particularly it deflects air and cuttings away from the operator and particularly away from the operators face.

Figure 20:
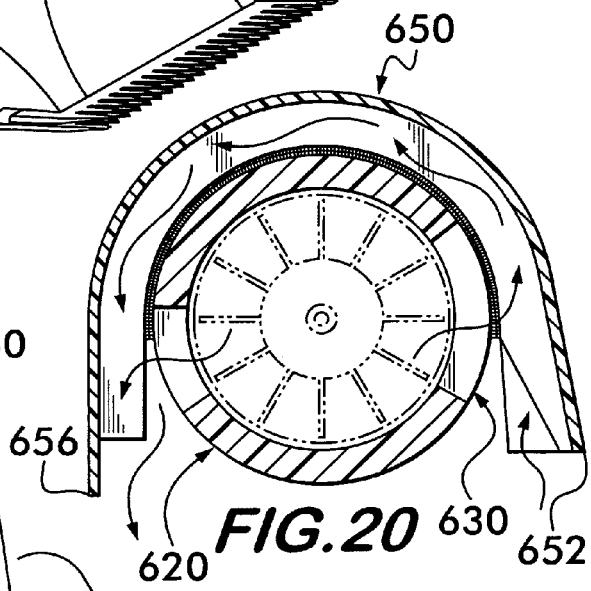
FIG. 20 is a cross sectional view taken along line 20-20 of FIG. 18.
Figure 19:
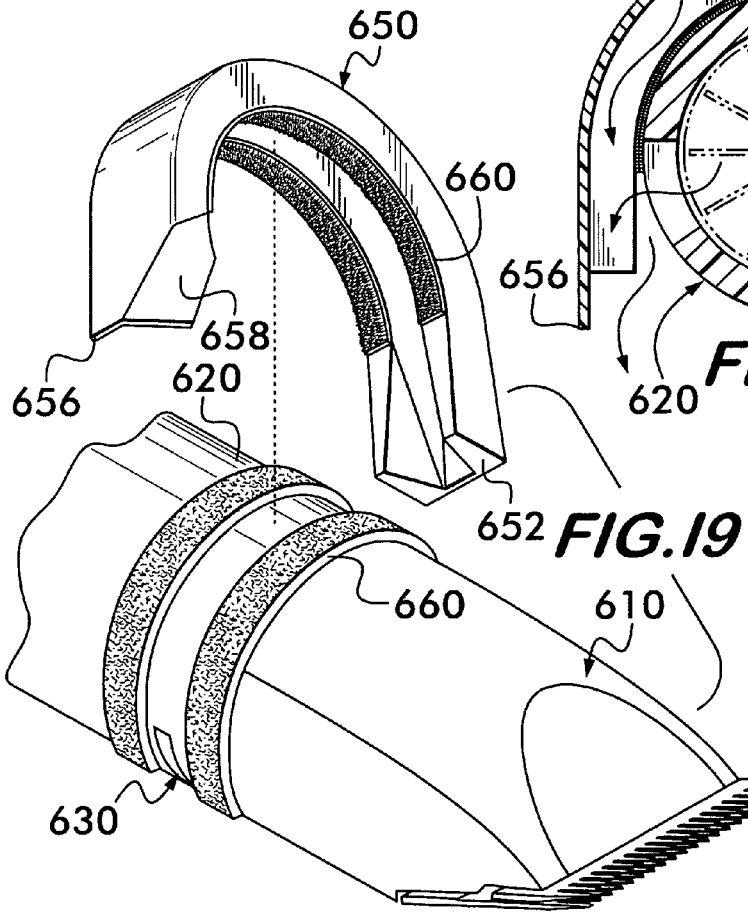
FIG. 19 is a partially broken away exploded view in perspective of the embodiment of FIG. 18 showing the deflector attachment being attached to the clipper.

As best illustrated in FIGS. 23 and 20, deflector 650 spans a circumference of housing 620 of clipper 610 by at least 120 degrees and preferably by more than 180 degrees and most preferably by approximately 262 degrees.

The embodiment of the invention shown in FIGS. 18-20 and 23 and described herein was built and tested to successfully operate as intended deflecting air and cutting debris away from the operator.

The present invention may be embodied in other specific forms without departing from the spirit or essential attributes thereof and, accordingly, reference should be made to the appended claims, rather than to the foregoing specification as indicating the scope of the invention.

I claim:

1. Air deflecting apparatus for use with an electric clipper with a cylindrical body portion having air outlet vents, the deflecting apparatus comprising a U-shape defining a receiving cavity, the deflecting apparatus having two inner walls each having a mating surface and defining a U-shaped channel there between; the U-shaped channel being in communication with the receiving cavity; the body portion with the outlet vents of the clipper being received in the receiving cavity in such a way that the vents are aligned with the channel so that air coming out of the vents flows into the channel and is directed by the channel away from the body portion of the clipper.

2. A clipper having an electric motor within a generally cylindrical housing with one or more outlets and a means for forcing cooling air over the motor and through the one or more outlets in the housing, a motor cooling air flow deflector being removable and mechanically attached to the housing and comprising a channel, the channel having a first and second end covering a span of at least 120 degrees of the housing further covering the one or more outlets, the channel being provided at the first end with a flared output and is provided at the second end with a vane for directing the cooling air from the channel via the forcing means along an outer surface of the housing.

3. The clipper in accordance with claim 2, the one or more outlets is a first outlet and a second outlet, the deflector having a catch for engaging a side wall of the first outlet and a spring member for engaging a side wall of the second outlet thereby defining the removable and mechanically attachment, wherein the deflector being attachable to and removable from the housing by flexing of the spring member.

4. The clipper in accordance with claim 3, further comprising a resilient seal provided between the deflector and the housing.

5. The clipper in accordance with claim 2, the housing including a key hole and the deflector including a key defining the removable and mechanical attachment.

6. The clipper in accordance with claim 2, the housing including hook and loop fastener material adjacent the one or more outlets and the deflector including hook and loop fastener material defining the removable and mechanical attachment.

7. In combination, a clipper having a generally cylindrical housing body with one or more outlets, the clipper including in the housing body an electric motor with an internal fan which forces air over the motor and exits the though the one or more outlets in the housing body; and an air deflector having a generally U-shape defining an opening, the deflector having a U-shaped channel with first and second ends, the deflector being removably attached to the housing body of the clipper in such a way that a portion of the housing body is received in the opening where the channel is in communication with the one or more outlets to redirect air exiting the one or more outlets in a direction defined by the first and second ends of the channel in relation to the housing body.

8. The combination of claim 7, the direction defined by the first and second ends of the channel in relation to the housing body is substantially tangential to a surface of the housing body of the clipper.

* * * * *